US008684286B2

(12) United States Patent
Hannich

(10) Patent No.: US 8,684,286 B2
(45) Date of Patent: Apr. 1, 2014

(54) INJECTION VALVE

(75) Inventor: Manuel Hannich, Lappersdorf (DE)

(73) Assignee: Continental Automotive GmbH, Hannover (DE)

( * ) Notice: Subject to any disclaimer, the term of this patent is extended or adjusted under 35 U.S.C. 154(b) by 874 days.

(21) Appl. No.: 12/504,732

(22) Filed: Jul. 17, 2009

(65) Prior Publication Data

US 2010/0019066 A1 Jan. 28, 2010

(30) Foreign Application Priority Data

Jul. 28, 2008 (DE) ..... 10 2008 035 087

(51) Int. Cl.
*B05B 1/30* (2006.01)

(52) U.S. Cl.
USPC ..... 239/585.5; 239/5

(58) Field of Classification Search
USPC ..... 239/5, 88, 89, 91, 94, 95, 533.2, 533.9, 239/533.12, 585.1–585.5, 584; 251/129.15, 251/129.21, 127
See application file for complete search history.

(56) References Cited

U.S. PATENT DOCUMENTS

| | | | | |
|---|---|---|---|---|
| 5,413,076 | A * | 5/1995 | Koenigswieser et al. | 123/446 |
| 6,102,302 | A * | 8/2000 | Nishimura | 239/96 |
| 6,382,189 | B1 * | 5/2002 | Hlousek | 123/506 |
| 6,679,435 | B1 * | 1/2004 | Noller et al. | 239/5 |
| 6,808,125 | B2 * | 10/2004 | Ruthardt et al. | 239/89 |
| 7,080,819 | B2 | 7/2006 | Tojo | 251/129.16 |
| 2002/0033423 | A1 | 3/2002 | Ruthardt et al. | 239/89 |
| 2007/0221745 | A1 | 9/2007 | Stoecklein et al. | 239/88 |

FOREIGN PATENT DOCUMENTS

| | | | |
|---|---|---|---|
| CN | 1637272 A | 7/2005 | F02M 47/00 |
| CN | 1942967 A | 4/2007 | F02M 51/06 |
| EP | 0971118 A2 | 1/2000 | F02M 47/00 |
| FR | 2808306 A1 | 11/2001 | F02M 47/02 |

OTHER PUBLICATIONS

French Preliminary Search Report, Application No. 0955145, 4 pages.

* cited by examiner

*Primary Examiner* — Davis Hwu
(74) *Attorney, Agent, or Firm* — King & Spalding L.L.P.

(57) ABSTRACT

An injection valve has a valve body and a nozzle body which is resting in a sealing fashion against the valve body, with a first valve body bore, in which bore a control piston and a stroke adjusting bolt are arranged so as to be moveable in the axial direction, with the control piston being embodied in order to be moved by a control means, with a second bore being provided in the nozzle body, with a nozzle needle being arranged in the second bore, the nozzle needle being provided to open or close an injection opening, with a tension spring being provided in the second bore, the tension spring stressing the nozzle needle in the direction of a sealing seat for the injection opening, with the first and second bore being actively connected to one another and with the stroke adjusting bolt being actively connected to the nozzle needle.

21 Claims, 3 Drawing Sheets

INJECTION VALVE

CROSS-REFERENCE TO RELATED APPLICATIONS

This application claims priority to DE Patent Application No. 10 2008 035 087.7 filed Jul. 28, 2008, the contents of which is incorporated herein by reference in its entirety

TECHNICAL FIELD

The invention relates to an injection valve.

BACKGROUND

Injection valves are used to supply internal combustion engines with fuel, said injection valves being supplied with fuel by way of a fuel supply line or a common rail system.

A piezoelectric actuator can be used as an actuation facility for controlling the injection valve, said piezoelectric actuator directly or indirectly controlling a nozzle needle by way of a servo valve.

With injection valves, which are supplied at a high fuel pressure, a relatively high leakage occurs as a result of the fuel pressure. Furthermore, the high pressures of the injection valve require a significant wall thickness of the injection valve.

SUMMARY

According to various embodiments, an injection valve with an improved design can be provided.

According to an embodiments, an injection valve may comprise a valve body and a nozzle body, wherein the nozzle body rests in a sealed manner against the valve body, a first bore being provided in the valve body, in which bore a control piston and a stroke adjusting bolt are arranged in a displaceable fashion in an axial direction, the control piston being embodied in order to be moved by an actuation means, a second bore being provided in the nozzle body, a nozzle needle being arranged in the second bore, said nozzle needle being provided to open or close an injection opening, a tension spring being provided in the second bore, said tension spring stressing the nozzle needle in the direction of a seal seat for the injection opening, with the first and the second bore being connected to one another, and wherein the stroke adjusting bolt being actively connected to the nozzle needle.

According to a further embodiment, the stroke adjusting bolt can be embodied as a cylindrical piston. According to a further embodiment, the first bore may have a smaller diameter than the second bore, and wherein the first and the second bore being arranged approximately flush, with a part of the contact surface of the valve body, which faces the nozzle body, covering a part of the second bore, with the part of the contact surface being provided as a stop surface for the nozzle needle. According to a further embodiment, the nozzle needle may have a collar, with an end of the nozzle needle, which faces the valve body, being provided with a moveably mounted sleeve, with the sleeve resting against a contact surface of the valve body, which faces the nozzle body, with the tension spring being stressed between the collar and the sleeve. According to a further embodiment, the first bore may have a first section, in which the control piston is guided, with the first bore comprising a second section, in which the stroke adjusting bolt is guided, with the first section having a different diameter to the second section. According to a further embodiment, the first and the second section may be arranged concentrically on a center axis. According to a further embodiment, a leakage bore may be embodied between the first bore and a leakage return line of the valve body. According to a further embodiment, the leakage bore may be guided from an outer edge of the valve body via the leakage return line to the first bore, with the leakage bore being sealed between the outer edge and the leakage return line using a closing means, in particular a sealing plug. According to a further embodiment, the control piston may comprise a tapered cross-section adjacent to the stroke adjusting bolt, and a leakage chamber being formed in this region.

BRIEF DESCRIPTION OF THE DRAWINGS

The invention is described in more detail below with reference to the Figures, in which.

DETAILED DESCRIPTION

With the injection valve according to various embodiments, the nozzle body rests against the valve body, whereby it is possible to dispense with a stop disk. The injection valve thus has a smaller installation length and a sealing surface.

Due to the omission of the stop disk, the stroke adjusting bolt is embodied in the form of a cylindrical piston.

A cost-effective manufacture of the stroke adjusting bolt is possible in this way.

It can be also advantageous for the control piston and the stroke adjusting bolt to be guided into a component. A precise manufacture of the guide surfaces and a precise alignment of the guide surfaces to one another is possible in this way. A defective position between the stroke adjusting bolt and the control piston is thus minimized.

In a further embodiment, a contact surface of the valve body is used as the contact surface for the nozzle needle. A defined maximum stroke of the nozzle needle is thus specified despite the omission of the stop disk.

In one embodiment, the tension spring is also arranged in the second bore of the nozzle body. The first bore, which is embodied in the valve body, can thus be embodied small so that a greater wall thickness in the valve body is possible without increasing the diameter of the injection valve. An increased pressure resistance in the injection valve is thus achieved. In a further embodiment, the control piston has a reduced diameter at the end assigned to the stroke adjusting bolt. A leakage chamber is thus provided in this region as a result of the constant diameter of the first bore.

In a further embodiment, the first bore has a first section for the control piston and the second bore has a second section for the stroke adjusting bolt. The first section has a larger diameter than the second section. Optimized use of the available installation space is enabled in this way. The first and the second section are arranged concentrically in respect of a center axis.

In a further embodiment, a leakage bore is embodied between the first bore of the valve body and a further leakage bore of the valve body. In this way, leakage can be discharged from the first bore.

The leakage bore can be guided to the edge of the injection valve as a function of the selected embodiment and can be outwardly sealed using a closing means.

Figure 1:
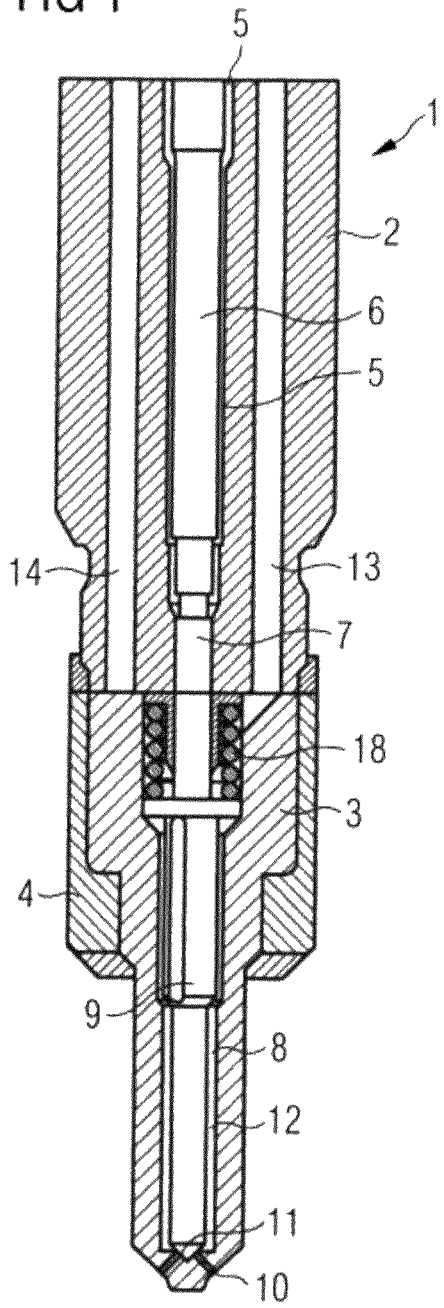
FIG. 1 shows a schematic partial representation of an injection valve.

FIG. 1 shows a schematic representation of a lower part of an injection valve 1 comprising a valve body 2 and a nozzle body 3. The valve body 2 rests directly against the nozzle body 3 and is stressed across a nozzle tensioning nut 4 with the valve body 2. A first bore 5 which is arranged along the longitudinal axis of the injection valve 1 is introduced into the valve body 2. A control piston 6 and a stroke adjusting bolt 7 are arranged in the first bore 5.

A second bore 8, in which a nozzle needle 9 is arranged so as to be axially moveable, is introduced into the nozzle body 3. Injection holes 10 are embodied on the lower end of the nozzle body 3, with a seal seat 11 being embodied upstream in the flow direction on the interior of the nozzle body 3, it being possible to close said seal seat using the nozzle needle 9. A nozzle chamber 12 is embodied between the nozzle needle 9 and the nozzle body 3, said nozzle chamber 12 being connected to a fuel supply line 13. Furthermore, a fuel return line 14 is embodied in the valve body 2. Leakage currents are guided back into a low pressure area, in particular to the fuel tank, by way of the fuel return line 14.

Figure 2:
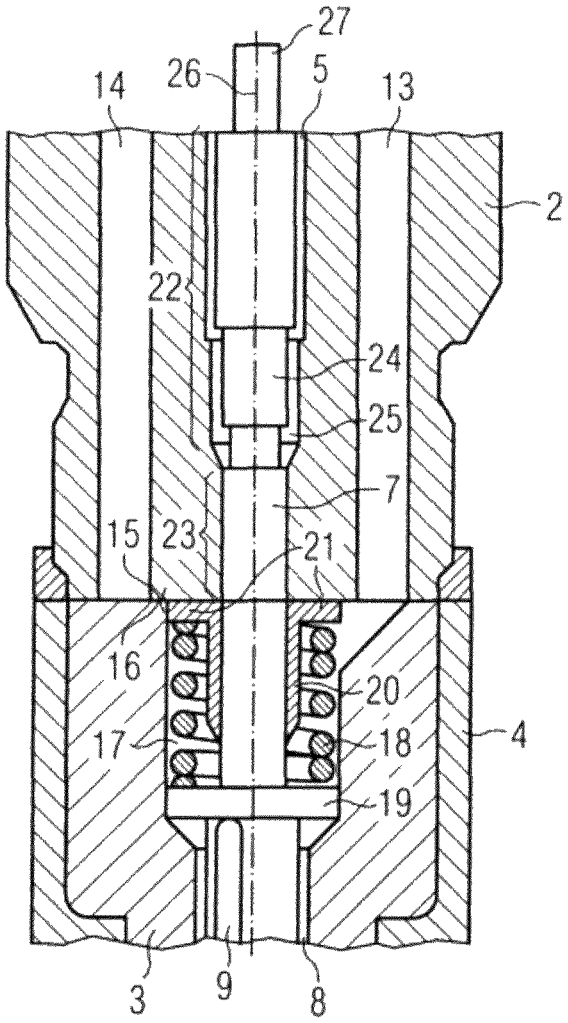
FIG. 2 shows an enlarged detail of the injection valve.

FIG. 2 shows an enlarged representation of a middle area of the injection valve 1. It is clearly apparent here that the valve body 2 has a first contact surface 15 on its underside, against which contact surface a second contact surface 16 of the nozzle body 3 rests. The second bore 8 has a spring chamber 17 in its upper end region, said spring chamber having an extended cross-section compared with a lower region of the second bore 8. A tension spring 18 is inserted into the spring chamber 17, said tension spring stressing the nozzle needle 9 downward toward the seal seat 11. In the exemplary embodiment shown, the tension spring 18 is embodied between a collar 19, which is embodied on the nozzle needle, and a tension sleeve 20. The collar can also be an additional component, e.g. a piston ring, which is clamped in a prefabricated groove. This produces a more cost-effective nozzle needle blank. The tension sleeve 20 is slid onto an upper end piece of the nozzle needle 9 in an axially displaceable fashion, and is stressed against the first contact surface 15 of the valve body 2. The tension sleeve 20 may have an annular projection 21 to hold the tension spring 18. The projection 21 may be embodied in the form of an annular disk for instance. The projection may also be omitted.

The first bore 5 has a first section 22 and a second section 23. The first section 22 extends into the second section 23, with the second section 23 ending on the first contact surface 15. The control piston 6 is guided into the first section 22. The stroke adjusting bolt 7 is guided into the first section 23. The control piston 6 has an end section 24 adjacent to the stroke adjusting bolt 7, said end section having a reduced diameter compared with an upper section of the control piston 6. A leakage chamber 25 is thus embodied in the region of the end section 24. The injection valve has a center axis 26, with the first and the second section 22, 23 being aligned symmetrically around the mid point in respect of the center axis 26. The second bore 8 is also likewise aligned symmetrically around the mid point in respect of the center axis 26.

The control piston 6 is actively connected to an actuation means 27. The actuation means 27 can act directly on the control piston 6 in the form of a piezoelectric actuator for instance or can actuate the control piston 6 by way of a hydraulic servo valve. Here the control piston 6 is applied with the pressure from a control chamber, which is supplied with high pressure fuel by way of an inlet throttle, with an outlet throttle being opened or closed with the aid of a piezoelectric actuator. Due to the measurements of the inlet and outlet throttle, a change in pressure can be achieved in the control chamber, with which the control piston is actuated.

Figure 3:
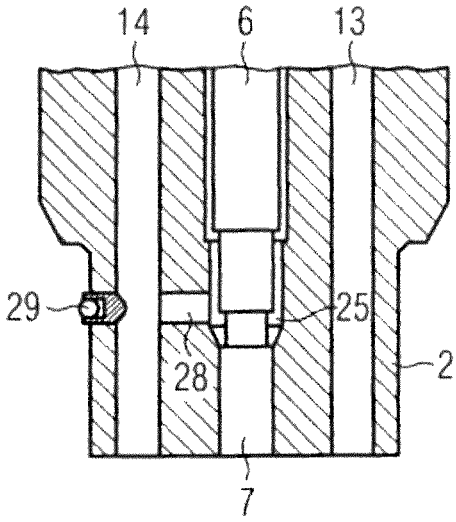
FIG. 3 shows a first embodiment of a leakage bore.

FIG. 3 shows a further schematic representation of a first solution for a leakage connection to the leakage chamber 25. A leakage bore 28 is guided here from the outside of the valve body 2 via the leakage return line 14 to the leakage chamber 25. The leakage bore 28 is closed as a closing means with the aid of a sealing plug 29.

Figure 4:
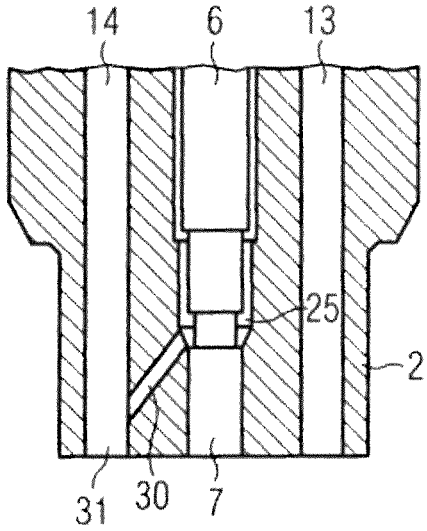
FIG. 4 shows a second embodiment of a leakage bore.

FIG. 4 shows a further embodiment, in which a second leakage bore 30 is guided into the leakage chamber 25 starting from the leakage return line 14. The second leakage bore 30 is embodied here at an angle smaller than 90° in respect of the center axis 26. The second leakage bore 30 can be introduced for instance by a lower opening of the leakage return line 14, which is embodied in the first contact surface 15.

The described injection valve has less sealing surfaces, so that a more minimal leakage can take place. Furthermore, the components are reduced as a result of the omitted stop disk. This also results in a cost reduction. The stroke adjusting bolt can also be embodied as a simple cylindrical bolt, so that the moving mass is also reduced. This also involves a reduction in the reaction inertia. Material costs can also be saved since the nozzle tensioning nut can be embodied shorter by at least 5 mm. In addition, assembly outlay is reduced as a result of the missing stop disk. In addition, wear is reduced by guides, since the guide surfaces in the first and second section of the first bore 5 have improved coaxiality in respect of the center axis 26 for the guidance of the control piston 6 and the stroke adjusting bolt 7 since both can be introduced into an agent. Furthermore, improved coaxialities of the components cause transverse forces resulting from the control piston, stroke adjusting bolt and nozzle needle to be reduced, thereby reducing the presence of the nozzle needle in the seal seat on the one hand and thus preventing increased wear as a result of such an overload of the functional surfaces.

The control piston can also be embodied thicker in the lower region, thereby resulting in a reduction in the buckling risk and/or in a reduction in the deflection of the control piston. The distance between the guiding region and the stroke adjusting bolt can also be optimized by dispensing with the tension spring in the valve body. The axial guiding position can be arranged in a more optimum region which corresponds to the assembly boundary conditions (type of projection in the cylinder head of the injector) in order to invoke less interaction between the environmental conditions and the sensitive control piston guide (injector leakage, injector timing). Furthermore, the high pressure resistance of the injector body is increased in the region of the leakage chamber 25, since a greater wall thickness is available. The injection valve also has a shorter length, which may lie in the region of 14 mm. Furthermore, the control piston can no longer be included during the assembly process, since the first bore 5 is tapered in the lower region.

What is claimed is:

1. An injection valve comprising a valve body and a nozzle body, wherein the nozzle body rests in a sealed manner against the valve body, a first bore being provided in the valve body, in which bore a control piston and a stroke adjusting bolt are arranged in a displaceable fashion in an axial direction, the control piston being embodied in order to be moved by an actuation means, a second bore being provided in the nozzle body, a nozzle needle being arranged in the second bore, said nozzle needle being provided to open or close an injection opening, a tension spring being provided in the second bore, said tension spring stressing the nozzle needle in the direction of a seal seat for the injection opening, with the first and the second bore being connected to one another, wherein the stroke adjusting bolt is actively coupled to the nozzle needle, wherein the first bore in the valve body in which the control piston and stroke adjusting bolt are arranged has a smaller diameter than the second bore in the needle body in which the nozzle needle is arranged, such that at a first end of the valve body facing a first end of the needle body, a portion of the valve body covers a portion of the second bore in the needle body, and wherein the tension spring is located axially between (a) the portion of the valve body covering the portion of the second bore in the needle body and (b) an end of the nozzle needle.

2. The injection valve according to claim 1, wherein the stroke adjusting bolt being embodied as a cylindrical piston.

3. The injection valve according to claim 1, wherein the first and the second bore are arranged approximately flush with each other.

4. The injection valve according to claim 1, wherein the nozzle needle having a collar, with an end of the nozzle needle, which faces the valve body, being provided with a moveably mounted sleeve, with the sleeve resting against a contact surface of the valve body, which faces the nozzle body, with the tension spring being stressed between the collar and the sleeve.

5. The injection valve according to claim 1, wherein the first bore having a first section, in which the control piston is guided, with the first bore comprising a second section, in which the stroke adjusting bolt is guided, with the first section having a different diameter to the second section.

6. The injection valve according to claim 5, wherein the first and the second section being arranged concentrically on a center axis.

7. The injection valve according to claim 1, wherein a leakage bore being embodied between the first bore and a leakage return line of the valve body.

8. The injection valve according to claim 7, wherein the leakage bore being guided from an outer edge of the valve body via the leakage return line to the first bore, with the leakage bore being sealed between the outer edge and the leakage return line using a closing means.

9. The injection valve according to claim 8, wherein the closing means is a sealing plug.

10. The injection valve according to claim 1, wherein the control piston comprising a tapered cross-section adjacent to the stroke adjusting bolt, and a leakage chamber being formed in this region.

11. A method of operating an injection valve comprising a valve body and a nozzle body, the method comprising the steps of:

resting the nozzle body in a sealed manner against the valve body, arranging in a bore provided in the valve body a control piston and a stroke adjusting bolt in a displaceable fashion in an axial direction, moving the control piston by an actuation means, opening or closing an injection opening by a nozzle needle being arranged in a second bore in the nozzle body, and stressing the nozzle needle by a tension spring in the direction of a seal seat for the injection opening, with the first and the second bore being connected to one another, wherein the stroke adjusting bolt being actively connected to the nozzle needle, wherein the nozzle needle includes a collar facing the valve body, and wherein a moveably mounted sleeve rests against a contact surface of the valve body facing the nozzle body, such that the tension spring is stressed between the collar and the sleeve.

12. The method according to claim 11, wherein the stroke adjusting bolt being embodied as a cylindrical piston.

13. The method according to claim 11, wherein the first bore having a smaller diameter than the second bore, and wherein the first and the second bore being arranged approximately flush, with a part of the contact surface of the valve body, which faces the nozzle body, covering a part of the second bore, with the part of the contact surface being provided as a stop surface for the nozzle needle.

14. The method according to claim 11, comprising the step of guiding the control piston in a first section of the first bore, and guiding the stroke adjusting bolt in a second section of the first bore, wherein the first section having a different diameter to the second section.

15. The method according to claim 14, wherein the first and the second section being arranged concentrically on a center axis.

16. The method according to claim 11, wherein a leakage bore being embodied between the first bore and a leakage return line of the valve body.

17. The method according to claim 16, comprising the step of guiding the leakage bore from an outer edge of the valve body via the leakage return line to the first bore, wherein the leakage bore being sealed between the outer edge and the leakage return line using a closing means.

18. The method according to claim 17, wherein the closing means is a sealing plug.

19. The method according to claim 11, wherein the control piston comprising a tapered cross-section adjacent to the stroke adjusting bolt, and a leakage chamber being formed in this region.

20. An injection valve comprising a valve body and a nozzle body, wherein the nozzle body rests in a sealed manner against the valve body, a first bore being provided in the valve body, in which bore a control piston and a stroke adjusting bolt are arranged in a displaceable fashion in an axial direction, the control piston being embodied in order to be moved by an actuation means, a second bore being provided in the nozzle body, a nozzle needle being arranged in the second bore, said nozzle needle being provided to open or close an injection opening, a tension spring being provided in the second bore, said tension spring stressing the nozzle needle in the direction of a seal seat for the injection opening, with the first and the second bore being connected to one another, wherein the stroke adjusting bolt is actively coupled to the nozzle needle, and wherein the nozzle needle includes a collar facing the valve body, and wherein a moveably mounted sleeve rests against a contact surface of the valve body facing the nozzle body, such that the tension spring is stressed between the collar and the sleeve.

21. An injection valve comprising a valve body and a nozzle body, wherein the nozzle body rests in a sealed manner against the valve body, a first bore being provided in the valve body, in which bore a control piston and a stroke adjusting bolt are arranged in a displaceable fashion in an axial direction, the control piston being embodied in order to be moved by an actuation means, a second bore being provided in the nozzle body, a nozzle needle being arranged in the second bore, said nozzle needle being provided to open or close an injection opening, a tension spring being provided in the second bore, said tension spring stressing the nozzle needle in the direction of a seal seat for the injection opening, with the first and the second bore being connected to one another, wherein the stroke adjusting bolt is actively coupled to the nozzle needle, wherein a leakage bore is embodied between the first bore and a leakage return line of the valve body, the leakage bore being guided from an outer edge of the valve body via the leakage return line to the first bore, with the leakage bore being sealed between the outer edge and the leakage return line using a closing means.

* * * * *